US007861693B2

(12) United States Patent
Einberger et al.

(10) Patent No.: US 7,861,693 B2
(45) Date of Patent: Jan. 4, 2011

(54) INJECTION SYSTEM FOR AN INTERNAL COMBUSTION ENGINE, AND INTERNAL COMBUSTION ENGINE

(75) Inventors: Adolf Einberger, Rimbach (DE); Thomas Grossner, Neutraubling (DE); Klaus Husslein, Regensburg (DE); Christoph Klesse, Wörth A.D.Donau (DE); Thomas Riedel, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 120 days.

(21) Appl. No.: 12/279,091

(22) PCT Filed: Feb. 8, 2007

(86) PCT No.: PCT/EP2007/051224

§ 371 (c)(1),
(2), (4) Date: Sep. 25, 2008

(87) PCT Pub. No.: WO2007/093554

PCT Pub. Date: Aug. 23, 2007

(65) Prior Publication Data

US 2009/0025685 A1 Jan. 29, 2009

(30) Foreign Application Priority Data

Feb. 15, 2006 (DE) ..... 10 2006 007 076

(51) Int. Cl.
*F02M 51/00* (2006.01)
*F02M 51/04* (2006.01)

(52) U.S. Cl. ..... 123/472; 123/446; 60/295

(58) Field of Classification Search ..... 123/446, 123/447, 456, 495, 472; 60/295, 286, 39.511
See application file for complete search history.

(56) References Cited

U.S. PATENT DOCUMENTS

| | | | | |
|---|---|---|---|---|
| 4,619,234 | A | 10/1986 | Okamoto | 123/357 |
| 6,260,353 | B1 * | 7/2001 | Takahashi | 60/286 |
| 6,425,374 | B1 | 7/2002 | Schmitz et al. | 123/436 |
| 6,848,423 | B2 | 2/2005 | Lettner et al. | |
| 6,904,354 | B2 | 6/2005 | Kuegel et al. | 701/104 |
| 7,069,138 | B2 | 6/2006 | Böhnig et al. | 701/104 |
| 7,333,886 | B2 | 2/2008 | Böhnig et al. | 701/114 |

(Continued)

FOREIGN PATENT DOCUMENTS

DE 19809173 3/1998

(Continued)

OTHER PUBLICATIONS

E. Schrüfer; Signalverarbeitung, Verlag Hanser, Book, pp. 235 and 238, 1990.

*Primary Examiner*—Mahmoud Gimie
(74) *Attorney, Agent, or Firm*—King & Spalding L.L.P.

(57) ABSTRACT

An injection system for an internal combustion engine has at least one injector (18) which is coupled hydraulically to a fuel accumulator (16), a prefeed pump (12) for feeding fuel from a fuel tank (10), a high pressure pump (14) which is arranged downstream behind the prefeed pump (12) for feeding the fuel into the fuel accumulator (16), and a line (42) which branches off downstream of the prefeed pump (12) and upstream of the high pressure pump (14) and is coupled hydraulically to an exhaust section injector (47), by way of which fuel can be injected into an exhaust section of the internal combustion engine.

14 Claims, 2 Drawing Sheets

U.S. PATENT DOCUMENTS

| | | | | |
|---|---|---|---|---|
| 2003/0079723 | A1 | 5/2003 | Mollin | 123/446 |
| 2003/0150428 | A1 | 8/2003 | Hozuki | 123/486 |
| 2003/0230076 | A1 * | 12/2003 | Kwon | 60/295 |
| 2004/0007214 | A1 | 1/2004 | Lettner et al. | |
| 2005/0188958 | A1 * | 9/2005 | Klenk et al. | 123/458 |
| 2007/0130922 | A1 * | 6/2007 | Dye et al. | 60/295 |
| 2007/0289287 | A1 * | 12/2007 | Tahara et al. | 60/277 |
| 2008/0245058 | A1 * | 10/2008 | Boddy et al. | 60/286 |

FOREIGN PATENT DOCUMENTS

| | | | |
|---|---|---|---|
| DE | 19910035 | | 3/1999 |
| DE | 19945618 | | 9/1999 |
| DE | 10215610 | | 4/2002 |
| DE | 10327533 | | 6/2003 |
| DE | 10328787 | | 6/2003 |
| DE | 10308618 | B4 | 1/2004 |
| DE | 10315467 | A1 | 1/2004 |
| DE | 102006006303 | | 2/2006 |
| EP | 0145993 | | 11/1984 |
| EP | 0732485 | A2 | 9/1996 |
| EP | 0761286 | A2 | 3/1997 |
| EP | 1296060 | A2 | 3/2003 |
| EP | 1526267 | | 8/2004 |
| EP | 1505271 | A1 * | 2/2005 |
| EP | 1296060 | B1 | 6/2005 |
| JP | 60006044 | | 1/1985 |
| JP | 61087941 | | 5/1986 |
| JP | 1155042 | | 6/1989 |
| JP | 4321741 | | 11/1992 |
| JP | 6173732 | | 6/1994 |
| JP | 2002039006 | A | 2/2002 |

* cited by examiner

INJECTION SYSTEM FOR AN INTERNAL COMBUSTION ENGINE, AND INTERNAL COMBUSTION ENGINE

CROSS-REFERENCE TO RELATED APPLICATIONS

This application is a U.S. national stage application of International Application No. PCT/EP2007/051224 filed Feb. 8, 2007, which designates the United States of America, and claims priority to German application number 10 2006 007 076.3 filed Feb. 15, 2006, the contents of which are hereby incorporated by reference in their entirety.

TECHNICAL FIELD

The invention relates to an injection system for an internal combustion engine, and an internal combustion engine.

In order to inject fuel into the combustion chambers of an internal combustion engine, in particular of a diesel internal combustion engine, injection systems are used, which have in recent years increasingly been embodied as so called common rail systems. In the case of these internal combustion engines, the injectors arranged in the combustion chambers are supplied with fuel from a common fuel accumulator known as the common rail. In this process, the fuel to be injected is at the time in the fuel accumulator under a pressure of up to 2000 bar.

Injection systems for internal combustion engines usually have different pumps by means of which fuel is transported, in order to be introduced into combustion chambers of the internal combustion engine. Such injection systems for internal combustion engines make high demands on the accuracy of the injection pressure required for injecting the fuel into the combustion chambers of the internal combustion engine.

This is particularly important because increasingly strict statutory regulations on the permissible emissions of harmful substances from internal combustion engines, mounted in motor vehicles, are issued. These make it necessary to take different measures by means of which the emissions of harmful substances are decreased. In this way, the formation of soot for example strongly depends on the preparation of the air/fuel mixture in the specific cylinder of the internal combustion engine. In this process, it is advantageous for decreasing the emissions of harmful substances if the fuel can be injected very accurately into the cylinder.

As further measures for the reduction of the emissions of harmful substances from motor vehicles, exhaust gas aftertreatment systems are used in internal combustion engines, which convert the emissions of harmful substances, which are generated during the combustion process of the air/fuel mixture in the specific cylinder, into harmless substances. In particular in the case of diesel engines, particle filters are used to this end, preferably soot filters. These must again be regenerated when a specific particle load is reached.

The regeneration of soot filters for an internal combustion engine, in particular a diesel engine, is known from the reference book "Lexikon Motorentechnik" [Encyclopedia of Engine Technology], edited by Richard van Basshuysen/Fred Schäfer, 1st edition, April 2004, Friedrich Vieweg & Sohn Verlag/GWV Fachverlage GmbH, Wiesbaden, page 808. In order to regenerate the soot filter, it is burnt off by means of hot exhaust gases. However, dry soot only burns off fast enough at temperatures exceeding 550 degrees Celsius. Because the exhaust gas temperatures are usually not high enough for this, additional measures have to be taken. In order to make combustion of the soot possible, active regeneration systems are used on the one hand. In this case, energy is released by means of a release signal in order to increase the exhaust gas temperature and in this way to burn off the soot in a reliable manner. This for example takes place by means of a burner, an electrical heating, a retarded injection or by means of catalytic combustion. On the other hand, additives can be added to the fuel, which decrease the reaction temperature.

From EP 1 296 060 B1, an injection system for an internal combustion engine is known by means of which with a prefeed pump, fuel can be fed from a fuel tank to the intake side of a high pressure pump. A high pressure pump arranged downstream behind the prefeed pump in a hydraulic manner, then feeds fuel into a fuel accumulator, from where it can then be distributed to injectors coupled hydraulically to the fuel accumulator. A control valve is arranged between the fuel tank and the prefeed pump, through which a fuel flow from the fuel tank to the prefeed pump can be regulated. In the case of a proper actuation of the control valve, a predefined pressure depending on the operating parameters of the internal combustion engine can be achieved in the fuel accumulator.

SUMMARY

An injection system for an internal combustion engine, and an internal combustion engine, can be created by means of which an operation of the internal combustion engine with very low emissions of harmful substances and a simple construction of the injection system is made possible.

According to an embodiment, an injection system for an internal combustion engine, may comprise a fuel accumulator, a prefeed pump for feeding fuel from a fuel tank, a high pressure pump arranged downstream behind the prefeed pump for feeding the fuel into the fuel accumulator, and a line which branches off downstream of the prefeed pump and upstream of the high pressure pump and is coupled hydraulically to an exhaust gas section injector, by way of which fuel can be injected into an exhaust gas section of the internal combustion engine.

According to another embodiment, an internal combustion engine may comprise such an injection system, and at least one cylinder in which a combustion chamber is embodied, into which fuel can be injected, it being possible that the exhaust gas section can be coupled hydraulically to the combustion chamber and that the exhaust gas section injector is arranged downstream of the combustion chamber and upstream of a particle filter.

BRIEF DESCRIPTION OF THE DRAWINGS

An advantageous embodiment of the invention is explained in more detail below using schematic drawings. These drawings are as follows.

In all the figures, the same reference characters refer to components with the same designs or functions.

DETAILED DESCRIPTION

In accordance with a first aspect, an injection system for an internal combustion engine may have at least one injector which is coupled hydraulically to a fuel accumulator, a prefeed pump for feeding fuel from a fuel tank, a high pressure pump which is arranged downstream behind the prefeed pump for feeding the fuel into the fuel accumulator, and a line which branches off downstream of the prefeed pump and upstream of the high pressure pump and is coupled hydraulically to an exhaust gas section injector, by way of which fuel can be injected into an exhaust gas section of the internal combustion engine.

This may be particularly advantageous because it is therewith possible to dispense with an additional feed unit such as for example an electrical feed pump for supplying the exhaust gas section injector. Rather, the prefeed pump used thus far in the injection system for supplying the exhaust gas section injector with fuel may be used, without having to make any modifications thereto. In particular, fuel can be branched off for the exhaust gas section injector via the line which branches off downstream of the prefeed pump and upstream of the high pressure pump, which is coupled hydraulically to the exhaust gas section injector, without thereby adversely affecting the feed performance of the high pressure pump.

In accordance with a second aspect, an internal combustion engine may have an injection system and at least one cylinder in which a combustion chamber is embodied into which fuel can be injected, it being possible that the exhaust gas section can be coupled hydraulically for flow to the combustion chamber and the exhaust gas section injector is arranged downstream of the combustion chamber and upstream of a particle filter.

This may be particularly advantageous because fuel can thereby be injected upstream of the particle filter into the exhaust gas section of the internal combustion engine and the exhaust gas temperature can thus be increased in order to regenerate the particle filter in this way. Over and above that, such an internal combustion engine is distinguished by a simple construction.

Figure 1:
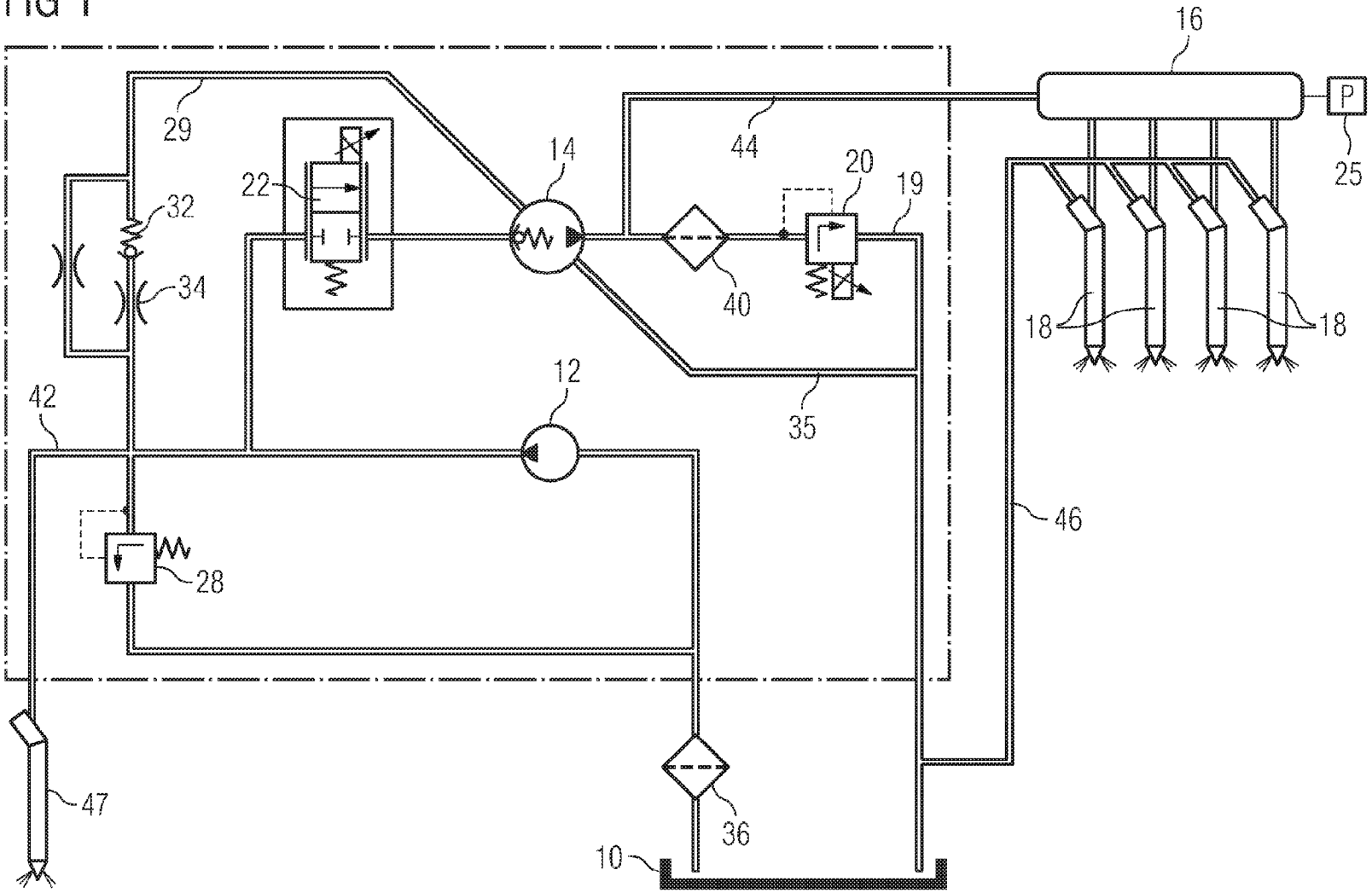
FIG. 1 shows a block diagram of an injection system for an internal combustion engine.
Figure 2:
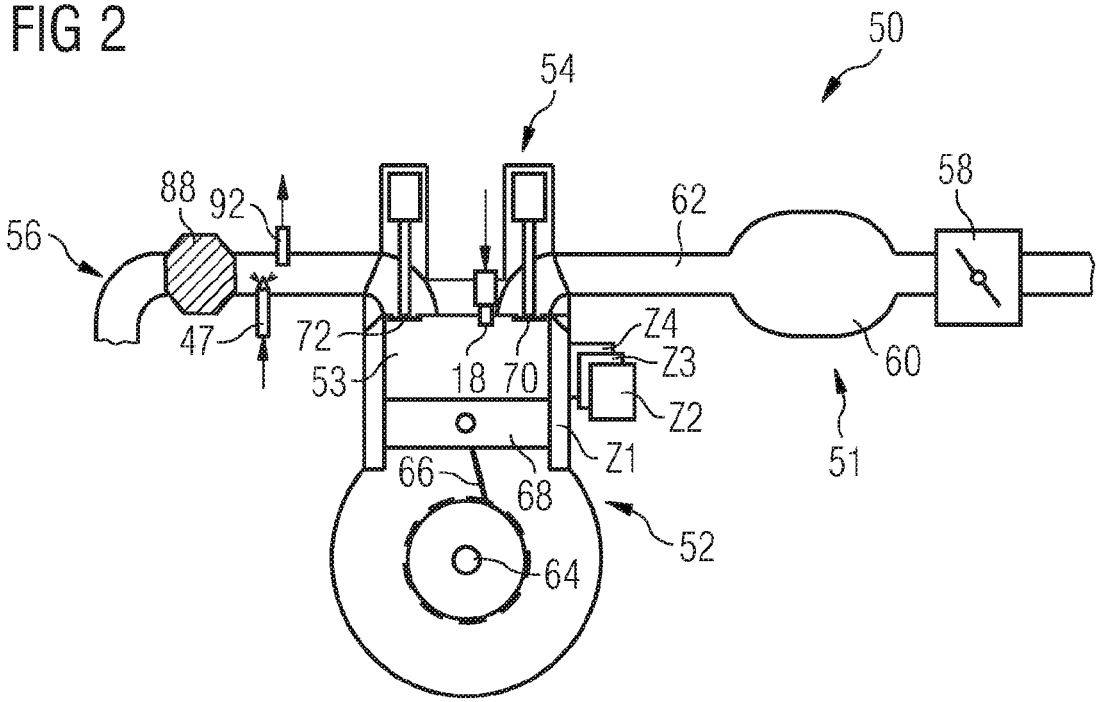
FIG. 2 shows a schematic view of an internal combustion engine.

The injection system for an internal combustion engine represented in FIG. 1 has a fuel tank 10, from which by means of a prefeed pump 12 fuel is fed. The prefeed pump 12 may be embodied as a vane pump in a preferred manner. However, another type of pump such as for example a geared pump or a gerotor pump can also be used for the prefeeding. The prefeed pump 12 can be driven mechanically by a drive shaft, which is not shown, and which is coupled to a motor shaft of the internal combustion engine 50 (FIG. 2). However, as an alternative it is possible to use an electrically operated prefeed pump, by means of which a control of the feed performance of the prefeed pump 12 is possible independently of the feed performance of other pumps.

The prefeed pump 12 is coupled hydraulically to a preliminary pressure regulating valve 28 on the outlet side, through which when a predetermined fuel pressure is exceeded on the outlet side of the prefeed pump 12, a part of the fuel fed from the prefeed pump 12 can be returned to the intake side of the prefeed pump 12. Because of this, the fuel pressure at the outlet side of the prefeed pump 12 can be limited.

A high pressure pump 14 for feeding the fuel into the fuel accumulator 16 is arranged downstream of the prefeed pump 12. The fuel accumulator 16 coupled hydraulically to the high pressure pump by means of a fuel accumulator feed line 44 coupled hydraulically. The high pressure pump 14 can be embodied as a radial piston pump or as a serial piston pump with a plurality of cylinder units in a preferred manner, in the same way as is known for their use in injection systems of internal combustion engines.

Furthermore, the fuel accumulator 16 is coupled hydraulically via lines to one injector 18 or a plurality of injectors 18. A combustion chamber 53 of the internal combustion engine 50 is assigned to each of the injectors 18 and each one can be actuated in such a way that fuel is injected into the combustion chamber 53. By means of the high pressure pump 14, the fuel to be injected by means of the injectors 18 into the combustion chambers 53 of the internal combustion engine 50 can reach a relatively high injection pressure.

Excess fuel can be returned by the injectors 18 via an injector return line 46 to the fuel tank 10.

A volumetric flow control/regulating valve 22 is arranged between the prefeed pump 12 and the high pressure pump 14, by means of which the fuel flow from the prefeed pump 12 into the high-pressure pump 14 can be adjusted. By way of a pressure sensor 25, by means of which the fuel pressure in the fuel accumulator 16 can be determined and as a function of, if required, other input variables, the volumetric flow control/regulating valve 22 can be actuated in such a way that a regulation of the fuel flow fed to the high pressure pump 14 is possible on the low-pressure side.

The high pressure pump 14 is connected to the pressure-regulating valve 20 by means of a return line 19 which branches off downstream of the high pressure pump 14 and upstream of the fuel accumulator 16, which pressure-regulating valve 20 can for example be actuated depending on the fuel pressure in the fuel accumulator 16 detected by means of the pressure sensor 25. When a predetermined fuel pressure is exceeded in the fuel accumulator 16, the pressure-regulating valve 20 can open and a part of the fuel fed by the high-pressure pump 14 can be returned to the fuel tank 10 via the return line 19.

Downstream of the prefeed pump 12 and upstream of the preliminary pressure regulating valve 28, a flush line 29 branches off, which opens on the outlet side into the housing of the high pressure pump 14, so that it is possible to flush the housing of the high pressure pump 14 with fuel during operation. Thus a cooling and lubrication of the high pressure pump 14 can be brought about. The fuel used for flushing purposes can subsequently be returned from the housing of the high pressure pump 14 via a flush return line 35 into the fuel tank 10.

In addition, a flush line throttle 34, and hydraulically in series to this a flush line valve 32, are arranged in the flush line 29. The flush line throttle 34 can limit the fuel flow through the flush line 29.

By way of the flush line valve 32, the fuel flow branching off via the flush line 29 can be released, if a predetermined fuel pressure is exceeded on the outlet side of the prefeed pump 12. In this process, it must be ensured that the flushing of the high pressure pump 14 only takes place at the moment when the operating pressure of the high pressure pump 14 has been reached. This is necessary, because it can only be ensured in this way that no fuel is branched off via the flush line 29 as long as the build-up of pressure on the intake side of the high pressure pump 14 has not yet been completed. In this process, the build-up of pressure on the intake side of the high pressure pump 14 is not delayed.

In order to protect the units arranged in the injection system, in particular the pumps 12, 14 and the control valves 22, 20, filters 36, 40 are arranged at appropriate places. In this way, in order to protect the prefeed pump 12, provision has been made for a first filter 36 arranged between the fuel tank 10 and the prefeed pump 12 in a hydraulic manner. Furthermore, a second filter 40 is arranged in order to protect the pressure-regulating valve 20.

The pressure-regulating valve 20 is arranged in the return line 19, which is coupled on the outlet side to the injector return line 46 of the at least one injector 18. The flush return line 35, the return line 19 and the injector return line 46 of the injectors 18 may be preferably returned to the fuel tank 10.

An exhaust gas section injector 47 is coupled hydraulically to a line 42 which branches off downstream of the prefeed pump 12 and upstream of the high pressure pump 14. By means of the exhaust gas section injector 47, fuel can be injected into an exhaust gas section 56 of the internal combustion engine 50, as described below.

FIG. 2 shows the internal combustion engine 50, with an intake section 51, an engine block 52, a cylinder head 54 and the exhaust gas section 56. The intake section 51 preferably may comprise a throttle valve 58, a manifold 60 and an intake pipe 62. The intake pipe 62 is guided to a cylinder Z1 by way of an intake port into the combustion chamber 53 of the engine block 52. The engine block 52 comprises further a crankshaft 64 that is connected to piston 68 of the cylinder Z1 by means of a connecting rod 66.

The cylinder head 54 comprises a gas intake valve 70 and a gas exhaust valve 72 as well as an injector 18.

A particle filter 88 is arranged in the exhaust gas section 56. The particle filter 88 may be preferably a soot filter. The exhaust gas section injector 47, by means of which the fuel can be injected into the exhaust gas section 56, is arranged downstream of the combustion chamber 53 and upstream of the particle filter 88.

In addition to cylinder Z1, provision may preferably also be made for additional cylinders Z2 to Z4. In further (not shown) embodiments, the internal combustion engine has five, six or eight cylinders.

In the following, the function of the injection system for the internal combustion engine 50 will be described briefly:

The prefeed pump 12 feeds the fuel from the fuel tank 10, it being possible that impurities in the first filter 36 can be retained between the fuel tank 10 and the prefeed pump 12. The pressure at the outlet of the prefeed pump 12 is adjusted by means of the preliminary pressure regulating valve 28. The fuel then arrives at the volumetric flow control/regulating valve 22. By way of the volumetric flow control/regulating valve 22, as much fuel as needed by the fuel accumulator 16 is made available to the high pressure pump 14. By means of the high pressure pump 14, the fuel is supplied via the fuel accumulator feed line 44 to the fuel accumulator 16. From the fuel accumulator 16, the fuel is fed to the injectors 18, and is injected by these into the combustion chambers 53 of the internal combustion engine 50. The fuel pressure required for the fuel accumulator 16 is determined by means of the pressure-regulating valve 20. Should the pressure in the fuel accumulator feed line 44 increase too strongly, and for this reason in the fuel accumulator 16, or should the pressure in the fuel accumulator 16 be decreased purposefully, then fuel can be discharged into the fuel tank 10 by means of the pressure-regulating valve 20. Furthermore, fuel from the flush return line 35 and the return line 46 is returned to the fuel tank by means of the injectors 18.

The feed performance of the mechanical prefeed pump 12 as well as that of the high pressure pump 14 is determined by the driving speed of the pumps. The driving speed of the prefeed pump 12 and that of the high pressure pump 14 is given by the ratio of the rotational speed of the pump in question to the rotational speed of the engine.

In the starting phase of the internal combustion engine 50, the flush line valve 32 is closed so that a pressure can build up on the intake side of the high pressure pump 14. The stroke volume of the prefeed pump 12 is selected distinctly larger than the feed volume of the high pressure pump 14, in order to guarantee in this way, on starting, a sufficient feed flow to the intake side of the high pressure pump 14.

A purposeful increase in the exhaust gas temperature, to support a regeneration of the particle filter 88, may be preferably carried out during a partial load operation or during full load operation of the internal combustion engine 50. To this end, it is necessary to feed fuel to the exhaust gas section injector 47 via the line 42 which branches off. The injection system is designed in such a way that during a full load operation of the internal combustion engine 50 a maximum required fuel feed volumetric flow of the high pressure pump 14 is ensured. In all the other working points of the internal combustion engine 50 it suffices if the high pressure pump 14 feeds a comparatively smaller fuel feed volumetric flow. However, because the prefeed pump can also provide a higher amount of fuel during the full load operation of the internal combustion engine 50 than is required for this, it is possible, both during the partial load operation and during the full load operation of the internal combustion engine 50, to branch off fuel for the exhaust gas section injector 47 via the branching off line 42, without the feed performance of the high pressure pump 14 being adversely affected. By supplying the exhaust gas section injector 47 with fuel from the injection system, the need to use further components, such as for example an electrical fuel pump, which can for example be arranged in the fuel tank, to supply the exhaust gas section injector 47 with fuel can be eliminated.

The invention claimed is:

1. An injection system for an internal combustion engine, comprising:

a fuel accumulator, a prefeed pump for feeding fuel from a fuel tank, a high pressure pump arranged downstream from the prefeed pump for increasing pressure of the fuel and feeding the higher pressure fuel into the fuel accumulator, and a line which branches off downstream of the prefeed pump and upstream of the high pressure pump and is coupled hydraulically to an exhaust gas section injector, wherein fuel is controllably and directly injected into an exhaust gas section downstream of a combustion chamber and upstream of a particle filter of the internal combustion engine.

2. The injection system according to claim 1, further comprising at least one injector coupled hydraulically to the fuel accumulator.

3. The injection system according to claim 1, wherein the prefeed pump is a vane pump.

4. The injection system according to claim 1, wherein the prefeed pump is coupled hydraulically to a preliminary pressure regulating valve.

5. The injection system according to claim 1, wherein the high pressure pump is a radial piston pump.

6. The injection system according to claim 1, wherein the high pressure pump is a serial piston pump with a plurality of cylinder units.

7. The injection system according to claim 1, wherein the fuel accumulator is coupled hydraulically via lines to a plurality of injectors.

8. The injection system according to claim 1, wherein a volumetric flow control/regulating valve is arranged between the prefeed pump and the high pressure pump.

9. The injection system according to claim 1, further comprising a pressure sensor for determining the fuel pressure in the fuel accumulator.

10. The injection system according to claim 1, wherein the high pressure pump is connected to a pressure-regulating valve by means of a return line which branches off downstream of the high pressure pump and upstream of the fuel accumulator.

11. The injection system according to claim 1, wherein a flush line branches off downstream of the prefeed pump and upstream of a preliminary pressure regulating valve.

12. An method for injecting fuel within an internal combustion engine, comprising feeding fuel with a prefeed pump from a fuel tank to a high pressure pump downstream from the prefeed pump, feeding the fuel with the high pressure pump to a fuel accumulator, and injecting the fuel controllably and directly into an exhaust gas section downstream of a combustion chamber and upstream of a particle filter of the internal combustion engine with an exhaust gas section injector coupled hydraulically to a line which branches off downstream of the prefeed pump and upstream of the high pressure pump.

13. An internal combustion engine comprising:

at least one cylinder in which a combustion chamber is embodied, into which fuel is injected by at least one injector coupled hydraulically to a fuel accumulator, a prefeed pump for feeding fuel from a fuel tank, a high pressure pump arranged downstream from the prefeed pump for increasing pressure of the fuel and feeding the higher pressure fuel into the fuel accumulator, and a line which branches off downstream of the prefeed pump and upstream of the high pressure pump and is coupled hydraulically to an exhaust gas section injector, wherein fuel is controllably and directly injected into an exhaust gas section downstream of a combustion chamber and upstream of a particle filter of the internal combustion engine, and wherein the exhaust gas section is coupled hydraulically to the combustion chamber and the exhaust gas section injector is arranged downstream of the combustion chamber and upstream of a particle filter.

14. The internal combustion engine according to claim 13, further comprising at least one injector coupled hydraulically to the fuel accumulator.

* * * * *